US012735782B2

(12) United States Patent
Brossard et al.

(10) Patent No.: US 12,735,782 B2
(45) Date of Patent: Sep. 15, 2026

(54) FILTRATION SYSTEM

(71) Applicant: ArcelorMittal, Schaan (LI)

(72) Inventors: Maxime Brossard, Metz (FR); Paul Durighello, Thionville (FR); Friederike-Franka Albrecht, Bremen (DE); Jan-Erik Hilger, Groß Ippener (DE); Luc Diez, Metz (FR)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 18/024,841

(22) PCT Filed: Sep. 6, 2021

(86) PCT No.: PCT/IB2021/058104
§ 371 (c)(1),
(2) Date: Mar. 6, 2023

(87) PCT Pub. No.: WO2022/053927
PCT Pub. Date: Mar. 17, 2022

(65) Prior Publication Data

US 2023/0357912 A1 Nov. 9, 2023

(51) Int. Cl.

| | |
|---|---|
| ***C23C 2/28*** | (2006.01) |
| ***C22C 18/00*** | (2006.01) |
| ***C23C 2/06*** | (2006.01) |
| ***C23C 2/40*** | (2006.01) |

(52) U.S. Cl.
CPC ..... *C23C 2/29* (2022.08); *C23C 2/40* (2013.01); *C22C 18/00* (2013.01); *C23C 2/06* (2013.01)

(58) Field of Classification Search
CPC ..... C23C 2/29; B05D 3/0426
See application file for complete search history.

(56) References Cited

U.S. PATENT DOCUMENTS

| | | | | |
|---|---|---|---|---|
| 6,379,820 | B1 * | 4/2002 | Komatsu | C23C 2/26 427/435 |
| 2011/0018178 | A1 | 1/2011 | Muller et al. | |
| 2014/0047729 | A1 | 2/2014 | Muller et al. | |
| 2018/0171458 | A1 | 6/2018 | Palepu et al. | |

FOREIGN PATENT DOCUMENTS

| | | | |
|---|---|---|---|
| CN | 103556095 | A | 2/2014 |
| CN | 110691865 | A | 1/2020 |
| EP | 2100673 | B1 | 1/2011 |
| JP | S56142860 | A | 11/1981 |
| JP | 10226865 | A | 8/1998 |
| JP | H10226865 | | 8/1998 |
| JP | H10298730 | A * | 11/1998 |

(Continued)

OTHER PUBLICATIONS

Search Report of PCT/IB2021/058104 of Oct. 19, 2021 and International Report on Patentability.

*Primary Examiner* — Alex A Rolland
(74) *Attorney, Agent, or Firm* — Davidson Kappel LLC

(57) ABSTRACT

A cooling method of a travelling coated steel strip, exiting a hot-dip coating bath, including the steps of A) sucking a gas into a cooling device, B) filtering the sucked gas by a filtering system capturing at least 50% of the particles having a size of at least 2.5 μm, C) blowing, at a velocity comprised from 1 to 80 $m \cdot s^{-1}$, the sucked and filtered gas onto the coated steel strip.

8 Claims, 4 Drawing Sheets

(56) References Cited

FOREIGN PATENT DOCUMENTS

| | | | | |
|---|---|---|---|---|
| JP | 2004018999 | A | * | 1/2004 |
| JP | 2006193791 | A | | 7/2006 |
| JP | 2634284 | A1 | | 9/2013 |
| JP | 2019151914 | A | | 9/2019 |
| KR | 20150073314 | A | | 7/2015 |
| KR | 20150075328 | A | | 7/2015 |
| UA | 99000 | U | | 5/2015 |
| WO | WO2013178470 | | | 12/2013 |

* cited by examiner

FILTRATION SYSTEM

The invention relates to a cooling method of a steel strip exiting a hot-dip coating bath, a cooling device and a cooling tower.

BACKGROUND

Nowadays, most of the steel products are coated to enhance their properties, especially their surface properties. As represented in FIG. 1, one of the most common continuous coating processes is the hot-dip coating, wherein the steel product to be coated S (e.g.: a band, a strip or a wire) is passed through a bath of molten metal 1, contained in a tank 2, which coats the steel product surface. After exiting the coating bath, the coated steel strip S passes between air knifes 3 permitting to adjust the coating thickness. Then, the steel strip enters a cooling tower 4 wherein a filtered gas 5, usually atmospheric air, is blown onto the coated strip by means of distribution chambers 6 in order to cool the steel strip to a desired temperature.

However, it has been observed that galvanized steel strips, coated with magnesium, aluminium and zinc, present dark spots 7 on the strip surface, as illustrated in FIG. 2. Those surface defects generally appear between the entrance and the exit of the cooling tower. It is admitted in the literature that for coating bath comprising magnesium and zinc, the presence of dark spots is due to the presence of $Mg_2Zn_{11}$ on the strip surface instead of primary Zn and $MgZn_2$.

A dark spot is a roundish defect present especially on the coating surface and has a diameter from a 100 μm to 50 mm. The dark spot defect is bright just after the coating of the steel and tends to be darkly dull afterwards, in the later course. This is why those dark spots are also known as a bright spots. The dark spot generally comprises a $Zn_{11}Mg_2$ phase. Moreover, the $Zn_{11}Mg_2$ is often at the extreme surface of the defect and can exhibit an impact area in the middle of the defect. The dark spot is also known in the literature as "freckle", "spot tour", "Sommersprosse" or "punto brillante". The thicker the steel product, the more dark spots are present on the product surface.

JP 10 226 865 discloses a method to avoid the presence of dark spots on the coated strip. In this hot-dip method for a Zn—Al—Mg coated sheet, the coating bath temperature is between its melting point and 450° C. and the coating cooling rate is limited at 10° C.·s$^{-1}$ or more. Alternatively, the coating bath can be at a temperature higher than 470° C. and the coating cooling rate is of at least 0.5° C.·s$^{-1}$.

U.S. Pat. No. 6,379,820 B1 discloses a method to increase the formation of $MgZn_2$ and thus reduce the formation of black spot. In this method, the hot dip coating is composed of Al: 4.0-10 wt. %, Mg: 1.0-4.0 wt. % and the balance of Zn and unavoidable impurities, has a bath temperature not lower than the melting point and lower than 470° C. Preferably, the bath has a Ti content from 0.002 to 0.1 wt % and a B content from 0.001 to 0.045 wt % to suppress the formation of $Mg_2Zn_{11}$. Moreover, this process has a cooling rate up to completion of plating layer solidification to not less than 10° C.·s$^{-1}$.

EP 2 634 284 A1 discloses a method to reduce the nucleation of $Mg_2Zn_{11}$ thanks to a system able to direct the wiping gas towards the bath and thus avoid Zn-splashing on the strip.

SUMMARY OF THE INVENTION

The inventors tried to identify another trigger of the $Mg_2Zn_{11}$ nucleation and came to the present invention reducing the formation of dark spot on coated steel strips during their cooling after exiting the a hot-dip coating bath.

The present disclosure provides a cooling method of a travelling coated steel strip (S), exiting a hot-dip coating bath (1), comprising the steps of: A) sucking a gas into a cooling device (8), B) filtering said sucked gas by means of a filtering system (9) capturing at least 50% of the particles having a size of at least 2.5 μm, C) blowing, at a velocity from 1 to 80 m·s$^{-1}$, said sucked and filtered gas onto said coated steel strip (S).

The present invention also provides a cooling device (8) of a cooling tower (4) comprising a filtration system (9) able to capture at least 50% of the particles having a size of at least 2.5 μm, a suction device (10) and at least a distribution chamber (6) comprising openings, wherein a gas is able to be filtered by said filtration system (9) and to be blown, through said openings of said distribution chamber and being able to execute the method described above.

BRIEF DESCRIPTION OF THE DRAWINGS

Other characteristics and advantages will become apparent from the following detailed description of the invention.

To illustrate the invention, various embodiment will be described, particularly with reference to the following figures.

DETAILED DESCRIPTION

In the following, upstream and downstream are expressed relative to the steel strip movement.

Figure 1:
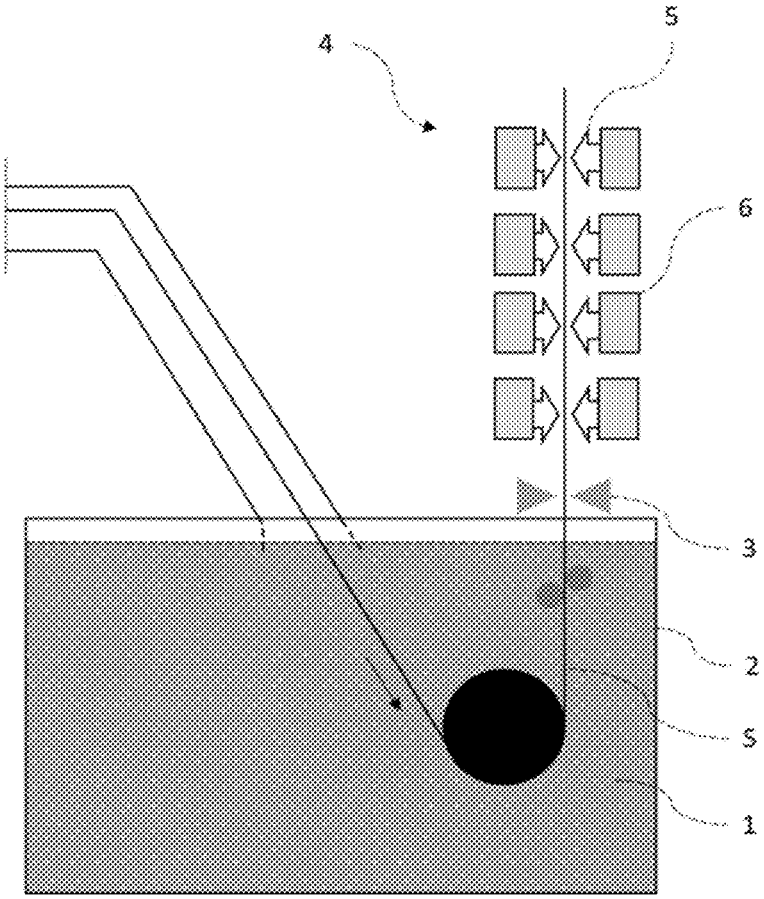
FIG. 1 is an embodiment of a hot-dip coating installation comprising a cooling tower.
Figure 2:
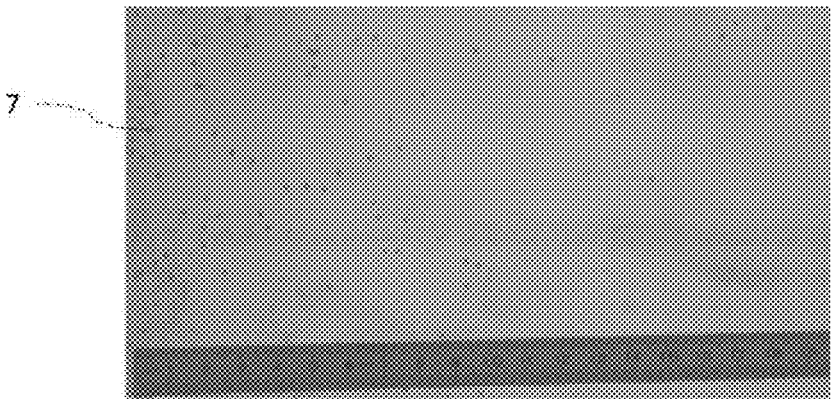
FIG. 2 is a picture of a steel strip presenting dark spots.
Figure 3:
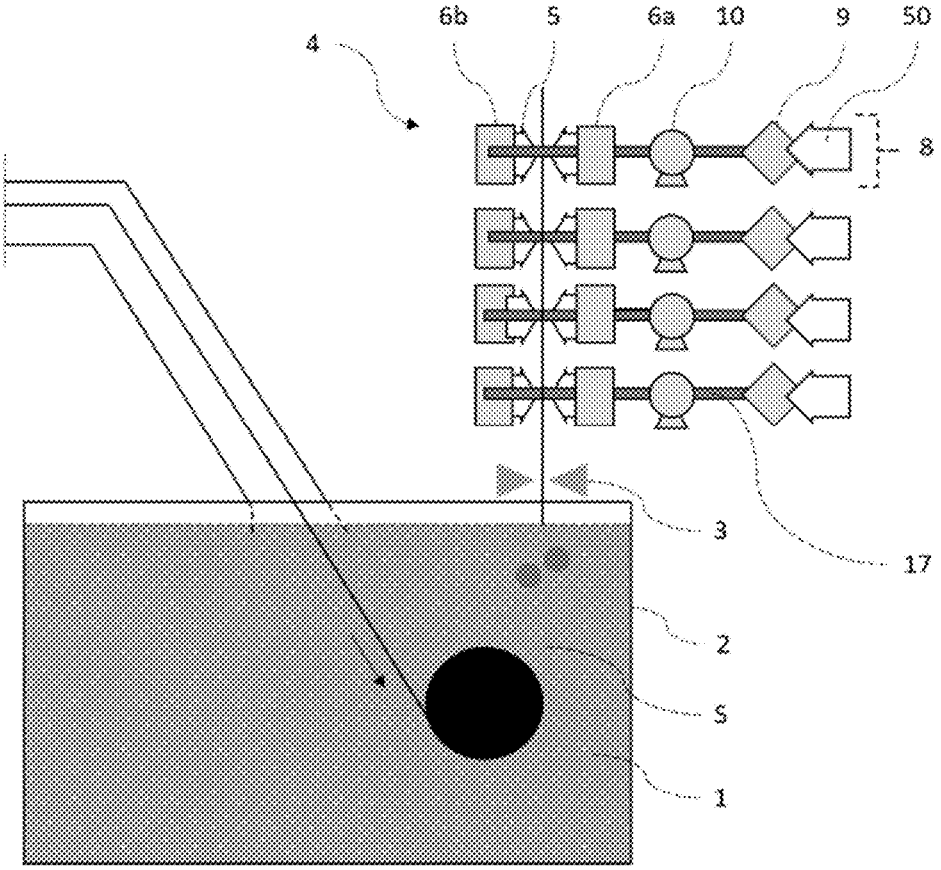
FIG. 3 is an embodiment of a hot-dip coating installation comprising a cooling device according to the present invention.

As illustrated in FIG. 3, the invention relates to a cooling method of a travelling coated steel strip S, exiting a hot-dip coating bath 1, comprising the steps of:

A) sucking a gas into a cooling device 8,

B) filtering said sucked gas by means of a filtering system 9 capturing at least 50% of the particles having a size of at least 2.5 μm, C) blowing, at a velocity from 1 to 80 m·s$^{-1}$, said sucked and filtered gas 5 onto said coated steel strip S.

This cooling method can take place in an installation as illustrated in FIG. 3 wherein the cooling tower 4 is positioned downstream, relative to the strip movement, a hot-dip coating tank 2 containing a hot-dip coating bath 1. The hot-dip coating bath 1 is a molten metal bath comprising a mix of several elements such as zinc, aluminium, silicon and/or magnesium.

Figure 4:
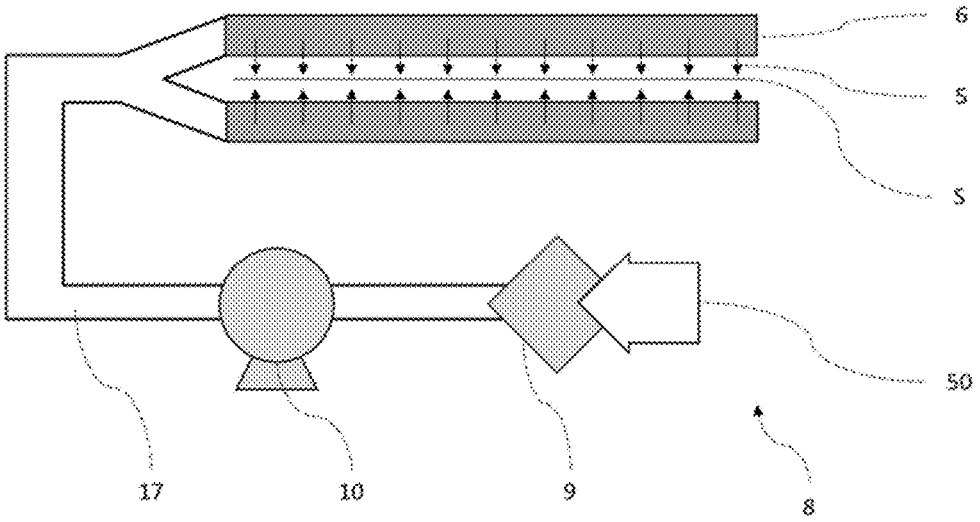
FIG. 4 is a first embodiment of a cooling device according to the present invention.

Said cooling tower 4 generally comprises at least a cooling device 8 comprising at least two distribution chambers (6*a* and 6*b*) arranged on either side of the travelling strip S, a suction device 10 and a filtering system 9. Each distribution chamber comprises openings which can be slots, nozzles or point-like openings. The openings face the travelling strip such that the gas 5 exiting the distribution chamber impacts the travelling coated steel product S, such as a strip. The distribution chamber can be set in such a way that the impacts of the jets from one module are opposite the jets of the other module or in a way that the impacts of the jets of gas on each surface of the strip are distributed at the nodes of a two-dimensional network and not opposite the impact of the jets on the other face such as described in EP 2 100 673 B1. Moreover, an air knife 3 can be positioned between the cooling tower 4 and the hot-dip coating tank 2 permitting to control the amount of coating, the coating thickness, of the coated steel strip. Furthermore, as illustrated in FIG. 4, the distribution chambers 6 are able to blow the filtered gas along the whole strip width.

A gas 50 (e.g. atmospheric air) is sucked into the cooling device 8 by a suction device 10 (e.g. a fan) and pass through a filtering system 9. Alternatively, the gas can come from a tank. The gas is thus filtered by a filtering system 9 having at least the performance of an PM2.5 filter.

The filter performance mentioned in this patent comes from the standard ISO 16980. A filter having the performance of an "PM2.5" filter captures at least 50% of the particles having a size of at least 2.5 μm. A filter having the performance of an "PM1" filter captures at least 50% of the particles having a size of at least 1.0 μm. Moreover, if a filter efficiency is above 50% for capturing particles having a determined size, its efficiency is rounded in 5%, to the closest, and added to the filter name. For example, if a filter captures 71% of particles having a size of at least 1 μm, it is known as an ePM1 70%.

Finally, the filtered gas is blown onto the travelling steel strip through the openings of the distribution chamber 6 resulting in gas jets 5 impacting, at a velocity comprised from 1 to 80 $m \cdot s^{-1}$, said strip and thus cooling it.

Consequently, when using the claimed cooling method, the blown air onto the travelling strip is freed from most of the particles and of the particles aggregate greater than 2.5 μm. This results in a severe diminution of the dark spot presence on the strip, as explained in the experimental results section.

Preferably, the sucked air passing through said filtering system capturing at least 50% of the particles having a size of at least 2.5 μm, has a velocity of maximum 1.5 $m \cdot s^{-1}$. It permits to even increase the efficiency of the filtering system.

Preferably, said travelling strip has a thickness from 0.2 to 10 mm. It has been observed that such a method is particularly advantageous for thick strip because they are the ones more prone to form dark spots. Even more preferably, said travelling strip has a thickness from 4 to 8 mm.

Preferably, said hot-dip coating bath comprises from 1 to 5 weight percent of magnesium, from 0.8 to 20 weight percent of aluminium and the remainder of the composition being made of zinc and inevitable impurities resulting from the elaboration. Preferably, said hot-dip coating bath comprises at least 1 weight percent of aluminium and even more preferably at least 1.8 weight percent of aluminium. Preferably, said hot-dip coating bath comprises at maximum 12 weight percent of aluminium. Even more preferably said hot-dip coating bath comprises at maximum 6 weight percent of aluminium. Preferably, said hot-dip coating bath comprises less than 0.5 weight percent and even more preferably less than 0.3 weight percent of each of the following elements: boron, cobalt, chromium, copper, molybdenum, niobium, nickel, vanadium, sulfur and titanium.

Preferably, in said step A) said sucked gas is a pure gas or a mixture of gases. It can be atmospheric air or a mixture consisting of nitrogen and hydrogen or any other mixture of gases.

Preferably, in said step B) said filtering system has at least the performance of an PM1 filter.

Even more preferably, in said step B) said filtering system has at least the performance of an ePM1 65% filter. Such an ePM1 65% filter captures at least 63% of particles having a size of at least 1 μm. It has been discovered by the inventors that not only particles bigger than 10 um favors the nucleation but also particles bigger than 1 μm favors the nucleation of $Mg_2Zn_1$ resulting in the formation of dark spots. This is explained in the experimental results section.

Preferably, in said step B) said filtering system has at least the performance of an ePM1 80% filter. Such an ePM1 80% filter captures at least 78% of particles having a size of at least 1 μm.

Preferably, in said step C) said coated steel strip has a coating being liquid. It means that the coating can be qualified as liquid coating, i.e. the coating is not solid. Apparently, the dark spots appearance is even more triggered by the impact of particles on the liquid coating.

Preferably, between said steps A and B, the cooling method comprises a step of filtering said sucked gas by means of a filtering system 9 able to capture less than 50% of particles having a size of at least 10 μm. Such a step permits to pre-filter the gas filtered in step B and extends the lifespan of the filtering system 9 having at least the performance of a PM2.5 filter.

The invention, as illustrated in FIGS. 3 and 4, also relates to a cooling device 8 of a cooling tower 4 comprising a filtration system 9 able to capture at least 50% of the particles having a size of at least 2.5 μm, a suction device 10 and at least a distribution chamber 6 comprising openings, wherein a gas is able to be filtered by said filtration system 9 and to be blown, through said openings of said distribution chamber and being able to execute the method previously explained.

This claimed cooling device 8 can be used in a cooling tower 4 of a hot-dip coating installation.

The cooling device comprises conduits 17 connecting its different parts such that all the blown gas is filtered. This is illustrated in FIG. 4, wherein conduits 17 connecting the filtration system 9 to the suction device 10 and the suction device 10 to the distribution chambers 6 are represented. Relative to the gas movement, the suction device is positioned downstream of the filtration system and upstream of the distribution chamber 12. The suction device 10 can be a fan.

Figure 5:
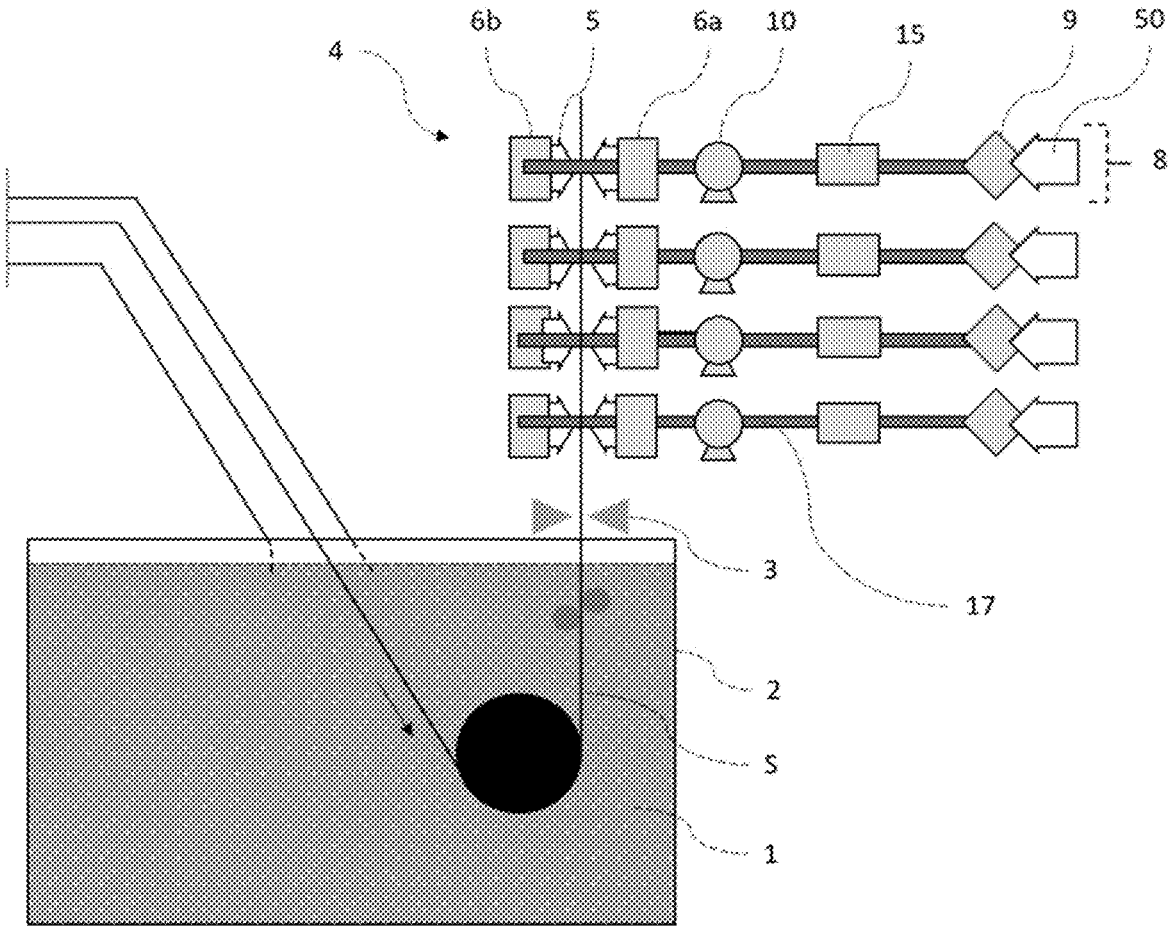
FIG. 5 is a second embodiment of a hot-dip coating installation comprising a cooling device according to the present invention.

Preferably, as illustrated in FIG. 5, said cooling device comprises a suction damper 15 able to adjust the flowrate of the blown gas. In this case, relative to the gas movement, the suction damper 15 is positioned downstream of the filtration system and upstream of the suction device.

Preferably, as illustrated in FIG. 4, said cooling device 8 comprises two distribution chambers, arranged on either side of a travel zone of a steel strip, able to blow the filtered gas towards said travel zone of a steel strip.

Figure 6:
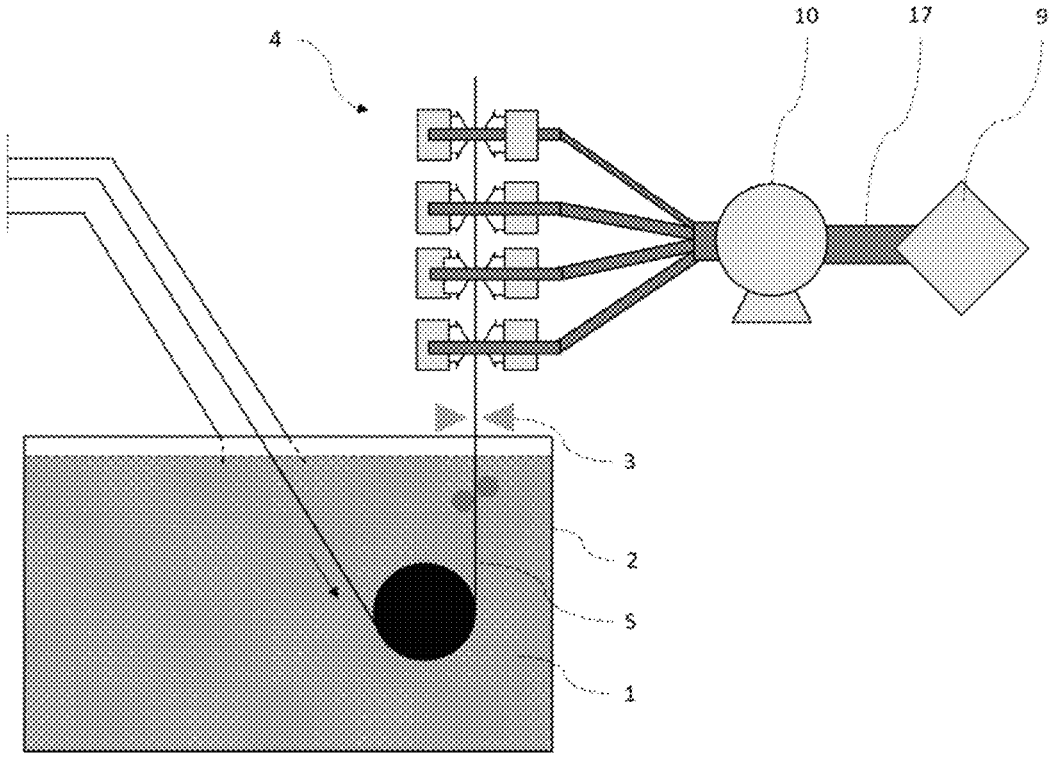
FIG. 6 is a third embodiment of a hot-dip coating installation comprising a cooling device according to the present invention.

Preferably, as illustrated in FIG. 6, said cooling device 8 comprises two to ten distribution chambers, arranged on either side of a travel zone of a steel strip, able to blow the filtered gas towards said travel zone of a steel strip.

Preferably, said filtration system 9, of the cooling device 8, comprises at least the performance of a PM1 filter. Even more preferably, said filtration system 9 has at least the performance of an ePM1 65% filter. Even more preferably, said filtration system 9 has at least the performance of an ePM1 80% filter. Apparently, such a filtration system permits to diminish even more the dark spots presence on the coated steel strip.

Preferably, said filtration system 9 comprises at least a pocket filter. Preferably, said filtration system comprises at least a rigid type filter made from glass fibre paper or nanofiber.

Preferably, said filtration system 9, of the cooling device 8, comprises at least a first filtration able to capture at least 50% of large coarse particles and at least a filtration means able to capture at least 50% of the particles having a size of at least 2.5 μm positioned downstream said first filtration means. In this particular case, downstream is to be understood relative to the path of the blown gas. Apparently, this permits to enhance the lifespan of the PM2.5 filter.

Preferably, said filtration system 9, of the cooling device 8, comprises at least a filtration mean able to capture at least 50% of the particles having a size of at least 2.5 μm and at least a filtration means having at least the performance of a PM1 filter or ePM1 65% filter or ePM1 80% filter.

Experimental Results

The experiments have been done in a hot-dip coating installation, as represented in FIG. 5, comprising a hot-dip coating tank 2 filled with a molten metal bath 1 comprising 3.7±0.2 weight percent of aluminium, 3.0±0.2 weight percent of magnesium and the remainder of the composition being made of zinc and inevitable impurities. The installation also comprises air knifes 3 and four cooling devices 8. Each cooling device comprises a filtering system, a suction device 10, a suction damper 15 and a pair of distribution chambers (6*a* and 6*b*), one on each side of the strip S. In all experiment, the strip is coated and cooled as previously explained.

Minimum Particle Size Impacting the Presence of Dark Spots

In this first experiment, in order to understand the impact of the size of the blown particles on the presence of dark spots, the blown air properties are changed and the numbers of dark spots per square meter of steel surface are compared. The number of dark spots is counted by visual inspection in order to estimate the presence of dark spots. For this experiment, the filtering system is able to filter particles bigger than 300 μm.

This experiment is conducted for several blown gases: atmospheric air or atmospheric air charged with $Al_2O_3$ particles of 1, 3, 9 or 20 μm. The air flow velocity of the blown air was of 11 $m \cdot s^{-1}$. The results are summed up in Table 1.

TABLE 1

| $Al_2O_3$ particles (in μm) | None | 0.3 | 1 | 3 | 10 | 20 |
|---|---|---|---|---|---|---|
| Number of dark spots per $m^2$ | 0 | 0 | ~10 | ~35 | >100 | >100 |

Based on the experimental results, it can clearly be observed that for the strip portion cooled by air charged with $Al_2O_3$ particles of at least 1 μm, dark spots appear on the strip surface. Moreover, the bigger the $Al_2O_3$ particles, the higher the number of dark spots per $m^2$. Consequently, in order to strongly lower the presence of dark spots, the quantity of particles of at least 9 μm should be lowered as much as possible. In order to suppress the presence of dark spots, the quantity of particles of at least 1 μm should be lowered as much as possible.

Comparative Results

In a second experiment, in order to assess the efficiency of the claimed process and equipments, the properties of the filtering system have been changed and the numbers of dark spots per square meter of steel surface compared. The number of dark spots is counted by an automatic inspection device.

In a first series of trials, where more than 10 coils have been produced, the filtering devices are able to filter particles bigger than 300 μm. In a second series of trials where more than 10 coils have been produced, the filtering devices of the two upper cooling devices are able to filter particles bigger than 300 μm and the filtering devices of the two lower cooling devices have the performance of an ePM1 65% filter. In a third series of trials, where more than 10 coils have been produced, the filtering devices of the four cooling devices have the performance of an ePM1 65% filter.

The density of dark spots on a coated steel coil is classified into three categories depending on the dark spot per square meter: less than 1 per $m^2$, from 1 to 20 per $m^2$ and above 20 per $m^2$.

In the first, second and third series, the steel strips has a thickness from 4 to 6 mm

TABLE 2

| | % of coils having | | |
|---|---|---|---|
| | <1 DS* · $m^{-2}$ | 1-20 DS · $m^{-2}$ | >20 DS · $m^{-2}$ |
| $1^{st}$ series | 14.3 | 38.1 | 47.6 |
| $2^{nd}$ series | 35.3 | 59.6 | 5.1 |
| $3^{rd}$ series | 75 | 25 | 0 |

*DS = dark spot

Based on the comparative results, it is clear that the implementation of the claimed invention reduces the number of dark spots on the coated steel strip exiting the cooling tower.

The invention has been described above as to the embodiment which is supposed to be practical as well as preferable at present. However, it should be understood that the invention is not limited to the embodiment disclosed in the specification.

What is claimed is:

1. A cooling method of a travelling coated steel strip, exiting a hot-dip coating bath, the method comprising the steps of:

A) sucking a gas into a cooling device;

B) filtering the sucked gas via a filtering system capturing at least 50% of the particles having a size of at least 1.0 μm;

C) blowing, at a velocity from 1 to 80 $m \cdot s^{-1}$, the sucked and filtered gas onto the coated steel strip, wherein the hot-dip coating bath comprises from 1 to 5 weight percent of magnesium and from 0.8 to 20 weight percent of aluminium, a remainder being made of zinc and inevitable impurities, wherein the steps A to C reduce the formation of nucleating $Mg_2Zn_{11}$ during cooling of steel strips coated with magnesium, aluminium and zinc exiting the hot-dip coating bath wherein in step B) the filtering captures particles having a size of 1.0 μm.

2. The method as recited in claim 1 wherein the filtering system has at least the performance of an ePM1 65% filter.

3. The method as recited in claim 1 wherein the filtering system has at least the performance of an ePM1 80% filter.

4. The method as recited in claim 1 wherein the blowing is through openings of a distribution chamber.

5. The method as recited in claim 1 wherein the sucking is by a suction device, and the sucking device is a fan.

6. The method as recited in claim 1 wherein the gas is atmospheric air.

7. The method as recited in claim 1 wherein the sucked and filtered gas is freed from particles aggregate greater than 2.5 μm.

8. The method as recited in claim 1 wherein the filtering system lowers a quantity of 9 μm $Al_2O_3$ particles in the sucked gas.

* * * * *